US009353474B2

(12) United States Patent
Bae et al.

(10) Patent No.: US 9,353,474 B2
(45) Date of Patent: May 31, 2016

(54) LAUNDRY DRYER

(75) Inventors: Sang Hun Bae, Changwon-si (KR); Chul Jin Choi, Changwon-si (KR); Dong Hyun Kim, Changwon-si (KR); Young Bok Son, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 696 days.

(21) Appl. No.: 12/376,981

(22) PCT Filed: Sep. 21, 2007

(86) PCT No.: PCT/KR2007/004638

§ 371 (c)(1),
(2), (4) Date: Feb. 10, 2009

(87) PCT Pub. No.: WO2008/038959

PCT Pub. Date: Apr. 3, 2008

(65) Prior Publication Data

US 2010/0154250 A1 Jun. 24, 2010

(30) Foreign Application Priority Data

Sep. 25, 2006 (KR) ..... 10-2006-0092850

(51) Int. Cl.

| | |
|---|---|
| ***D06F 58/00*** | (2006.01) |
| ***F26B 11/02*** | (2006.01) |
| ***F26B 19/00*** | (2006.01) |
| ***D06F 58/20*** | (2006.01) |
| ***D06F 58/26*** | (2006.01) |

(52) U.S. Cl.

CPC ..... *D06F 58/203* (2013.01); *D06F 58/26* (2013.01)

(58) Field of Classification Search

USPC ..... 34/549, 132, 89, 389, 390, 470, 514, 34/542, 552, 555, 566, 571, 578, 597, 134, 34/198, 200, 86, 122, 124, 125; 165/109.1, 148–153

See application file for complete search history.

(56) References Cited

U.S. PATENT DOCUMENTS

| | | | | | |
|---|---|---|---|---|---|
| 2,389,433 | A | * | 11/1945 | Hough | 34/87 |
| 2,529,545 | A | * | 11/1950 | Edwards | 165/184 |
| 2,688,806 | A | * | 9/1954 | Long | 34/75 |
| 3,180,037 | A | * | 4/1965 | Kenreich et al. | 34/597 |
| 3,239,947 | A | * | 3/1966 | Kenreich et al. | 34/597 |
| 3,242,584 | A | * | 3/1966 | Jacobs | 34/448 |
| 3,998,188 | A | * | 12/1976 | Priest et al. | 122/250 R |
| 4,130,071 | A | * | 12/1978 | Porter | 110/245 |

(Continued)

FOREIGN PATENT DOCUMENTS

| | | |
|---|---|---|
| CN | 2429730 Y | 5/2001 |
| CN | 1680650 | 10/2005 |

(Continued)

OTHER PUBLICATIONS

International Search Report dated Jun. 26, 2008.

(Continued)

*Primary Examiner* — Kenneth Rinehart
*Assistant Examiner* — John McCormack
(74) *Attorney, Agent, or Firm* — Ked & Associates LLP

(57) ABSTRACT

A laundry dryer is provided which is capable of removing and/or preventing wrinkles of laundry. The laundry dryer includes a drum in which laundry is held, a hot air heater that heats air to supply hot air to the drum, and a water heating part that heats water by using the heats generated at the hot air heater to generate steam.

7 Claims, 6 Drawing Sheets

(56) References Cited

U.S. PATENT DOCUMENTS

| | | | | |
|---|---|---|---|---|
| 4,615,122 | A * | 10/1986 | Sherrod et al. | 34/422 |
| 5,014,338 | A * | 5/1991 | Glucksman | 392/405 |
| 5,172,490 | A * | 12/1992 | Tatsumi et al. | 34/488 |
| 2005/0241812 | A1* | 11/2005 | Malone et al. | 165/150 |
| 2005/0262644 | A1 | 12/2005 | Oak et al. | |
| 2006/0086001 | A1* | 4/2006 | Jeong et al. | 34/606 |
| 2006/0096333 | A1* | 5/2006 | Park et al. | 68/15 |
| 2007/0006479 | A1* | 1/2007 | Salgado-Mangual | 34/134 |
| 2007/0006484 | A1* | 1/2007 | Moschuetz et al. | 34/597 |
| 2008/0282750 | A1* | 11/2008 | Yang et al. | 68/5 C |
| 2012/0005915 | A1* | 1/2012 | Song et al. | 34/132 |

FOREIGN PATENT DOCUMENTS

| | | | | |
|---|---|---|---|---|
| CN | 1769772 | 5/2006 | | |
| DE | 4306217 | 9/1994 | | |
| DE | 10260151 | 7/2004 | | |
| EP | 1 584 728 | 10/2005 | | |
| JP | 2004-313231 | 11/2004 | | |
| KR | 10-0640788 | 11/2006 | | |
| KR | 10-0672439 | 1/2007 | | |
| WO | WO 2004/059070 | 7/2004 | | |
| WO | WO2004059070 | A1 * | 7/2004 | D06F 58/20 |

OTHER PUBLICATIONS

Chinese Office Action dated May 19, 2011 (Application No. 200780035567.0).

German Office Action dated Aug. 8, 2011. (Application No. 112007002243.4).

Chinese Office Action dated Mar. 7, 2012 with English Translation.

* cited by examiner

LAUNDRY DRYER

TECHNICAL FIELD

The present invention relates to a laundry dryer. More specifically, the present invention relates to a laundry dryer capable of removing and/or preventing wrinkles of laundry.

BACKGROUND ART

Laundry dryers are typically electric appliances that dry washed laundry, mainly washed clothes, by using high temperature air. In general, a laundry dryer is configured of a drum, a driving source, heating means and a blower unit. Laundry is held in the drum and the driving source drives the drum. The heating means heats air drawn in the drum. The blower unit sucks or discharges the air inside the drum.

Laundry dryers may be categorized, based on a method of heating air that is heating means, into electric-type laundry dryers and gas-type laundry dryers. In an electric-type laundry dryer, air is heated by using electric resistance heat. While, in a gas-type laundry dryer, air is heated by using heat generated from gas combustion. On the other hand, laundry dryers may be categorized into condensation-type laundry dryers and exhaustion-type laundry dryers. In a condensation-type laundry dryer, air is heat-exchanged with laundry in the drum and the damp air is circulated, not discharged outside, to be heat-exchanged with external air at an auxiliary condenser. At this time, water is condensed and discharged outside. In an exhaustion-type laundry dryer, air is heat-exchanged with laundry in the drum and the damp air is directly discharged outside the laundry dryer. Also, laundry dryers may be categorized, based on a method of loading laundry, into top loading-type laundry dryers and front loading-type laundry dryers. In a top loading-type laundry dryer, laundry is loaded into the drum through a top of the laundry dryer. In a front loading-type laundry dryer, laundry is loaded into the drum through a front of the laundry dryer.

DISCLOSURE OF INVENTION

Technical Problem

However, above conventional laundry dryers may have following problems.

Commonly, the laundry having performed washing and spinning is loaded and dried in the conventional laundry dryers. In a view of a principle of water washing, washed laundry has wrinkles and the wrinkles created during the washing and spinning are not removed during the drying. As a result, auxiliary ironing is necessary in the conventional laundry dryer to remove the wrinkles, which causes a problem.

Moreover, in case that clothes rather than the washed laundry are kept and used, the clothes like the washed laundry may have wrinkles, crumples and fold marks (hereinafter, referenced to as wrinkles). Accordingly, there have been demands for development of devices capable of removing wrinkles easily even after common usage and keeping.

Technical Solution

To solve the problems, an object of the present invention is to provide a laundry dryer that can prevent and/or remove wrinkles of laundry.

Another object of the present invention is to provide a laundry dryer that has an improved steam generator.

To achieve these objects and other advantages and in accordance with the purpose of the invention, as embodied and broadly described herein, a laundry dryer includes a drum in which laundry is held; a hot air heater that heats air to supply hot air to the drum; and a water heating part that heats water by using the heat generated at the hot air heater to generate steam. Here, the water heating part may be provided at an outer surface of the housing. The water heating part may be provided in front or rear of the housing. In this case, the laundry dryer may further include a duct that holds the hot air heater and the water heating part. It is preferable that the water heating part is formed in a pipe shape. The laundry dryer may further include a fin provided at the water heating part to enhance heat-exchange efficiency. A temperature sensor may be provided at a predetermined portion of the water heating part. It is preferable that a warning is given to a user if the temperature of the water heating part is beyond the predetermined temperature range. It is preferable that an operation of the heat generating part is stopped if a temperature of the water heating part is beyond a predetermined range.

On the other hand, the laundry dryer may further include a damper that selectively stops the hot air generated at the hot air generator from being supplied to the drum. It is preferable that the damper is provided at a hot air supply duct. The steam generated at the water heating part is supplied to the drum through a hot air supply duct.

Advantageous Effects

The present invention has an advantageous effect of preventing and/or removing wrinkles of laundry efficiently.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

To explain a laundry dryer according to the present invention, a top loading-type, electric-type and exhaustion-type laundry dryer will be presented as examples on convenience sake. However, the present invention is not limited to the above examples and it can be applicable to a front loading-type, gas-type and condensation-type laundry dryer.

Figure 1:
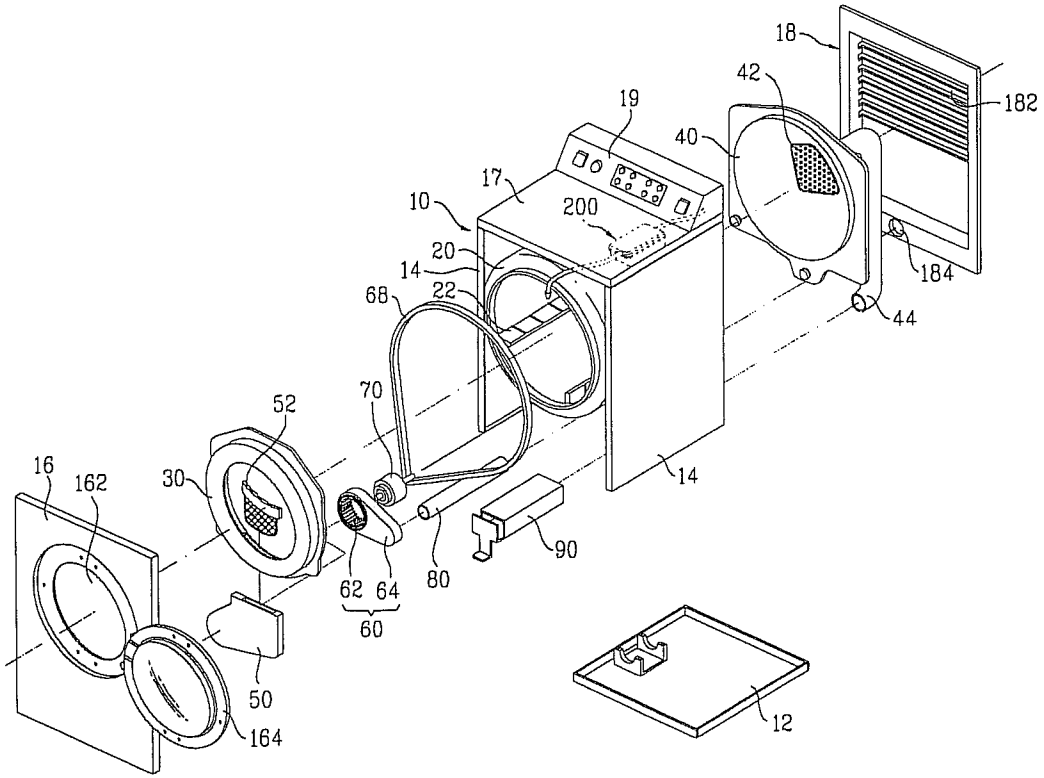
FIG. 1 RELATED ART
FIG. 1 is an exploded perspective view illustrating a laundry dryer having a steam generator.
Figure 2:
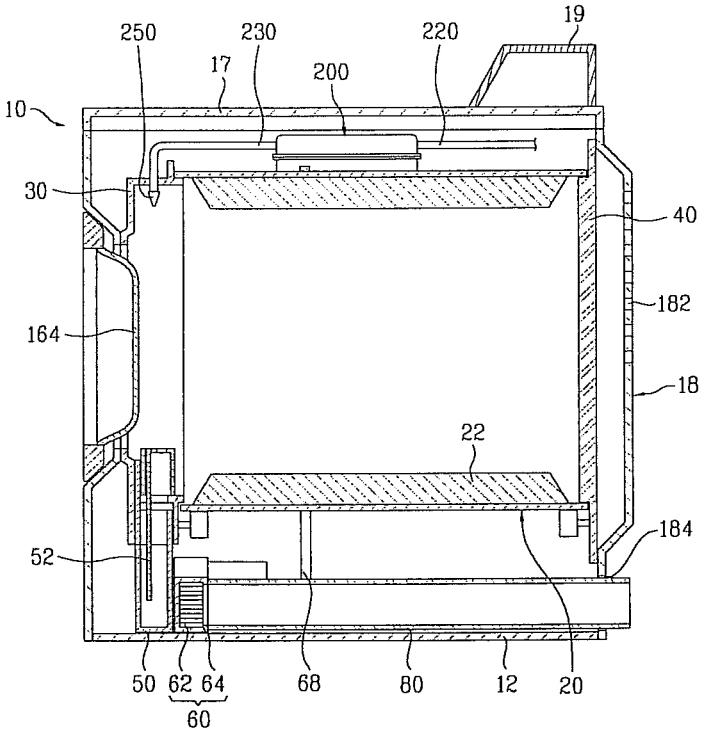
FIG. 2 RELATED ART
FIG. 2 is a longitudinally sectional view of FIG. 1.

In reference to FIGS. 1 and 2, a laundry dryer having a steam generator will be explained.

A cabinet 10 defines an exterior appearance of the laundry dryer and a drum 20 is rotatable in the cabinet 10. A motor 70 and a belt 68 drive the drum 20.

A hot air heater 90 is provided in a predetermined portion of the cabinet 10 to heat air and to create high temperature air (hereinafter, hot air). A hot air supply duct 44 is provided in a predetermined portion of the cabinet 10 to supply the hot air of the hot air heater 90 to the drum 20. Also, there are provided an exhaustion duct 80, a blower unit 60 in the laundry dryer. The damp air heat-exchanged with the laundry in the drum 20 is discharged outside the drum 20 through the exhaustion duct 80 and the blower unit 60 sucks the damp air. A steam generator 200 is provided in a predetermined portion of the cabinet 10 to generate high temperature steam.

This dryer presents on convenience sake an indirect drive type in that the drum 20 is rotated by the motor 70 and the belt 68 and this laundry dryer is not limited thereto. That is, it is possible to apply to the laundry dryer a direct drive type in that the drum 20 is directly rotated by connecting the motor 70 to a rear surface of the drum 20.

Each configuration will be explained in detail.

The cabinet 10 defines an exterior appearance of the laundry dryer and it includes a base 12, a pair of side covers 14, a front cover 16, a rear cover 18 and a top cover 17. The base 12 forms a bottom surface of the laundry dryer and the side covers 14 are perpendicular to the base 12. The front cover 16 and the rear cover 18 are installed in a front portion and a rear portion of the side covers 14, respectively. The cover top 17 is installed in an upper portion of the side covers 14. A control panel 19 having various operational switches is positioned at the top cover 17 or the front cover 16 and the door 164 is coupled to the front cover 16. An air inlet 182 and an air outlet 184 are provided at the rear cover 18. External air is drawn through the air inlet 182 and the air inside the drum 20 is discharged outside through the air outlet 184 that is a final path to an outside.

An inner space of the drum 20 is employed as a drying chamber for drying the laundry. It is preferable that a lifter 22 is installed in the drum 20 to lift and drop the laundry, such that the laundry is turned over to enhance drying efficiency.

On the other hand, a front supporter 30 is provided between the drum 20 and the cabinet 10, in other words, between the drum 20 and the front cover 16. A rear supporter 40 is provided between the drum 20 and the rear cover 18. The drum 20 is rotatable between the front supporter 30 and the rear supporter 40, and sealing members (not shown) for preventing water leakage are coupled between the front supporter 30 and the drum 20 and between the drum 20 and the rear supporter 40, respectively. The front supporter 30 and the rear supporter 40 of the drum 20 close a front and a rear surface, respectively, to support a front and rear end of the drum 20 as well as to form the drying chamber.

An opening is formed at the front supporter 30 to communicate the drum 20 with an outside and the opening is selectively opened and closed by the door 164. In addition, a lint duct 50 as a path through which the air in the drum 20 flows outside is connected to the front supporter 30 and a lint filter 52 is installed at the lint duct 50. A predetermined portion of the blower unit 60 is connected to the lint duct 50 and the other opposite predetermined portion of the blower unit 60 is connected to the exhaustion duct 80. Here, the exhaustion duct 80 is in communication with the air outlet 184 provided at the rear cover 18. As a result, once the blower unit 60 is operated, the air inside the drum 20 flows through the lint duct 50, the exhaustion duct 80 and the air outlet 184 in order, only to be exhausted outside. At this time, foreign substances including lint are filtered by the lint filter 52. Commonly, the blower unit 60 is configured of a blower 62 and a blower housing 64. The blower 62 is commonly connected to the motor 70 for driving the drum 20.

An opening 42 formed of plural through-holes is formed at the rear supporter 40 and the hot air supply duct 44 is connected to the opening 42. The hot air supply duct 44 is in communication with the drum 20 and it is employed as a path for supplying hot air to the drum 20. For that, the hot air heater 90 is mounted in a predetermined portion of the hot air supply duct 44.

Figure 3:
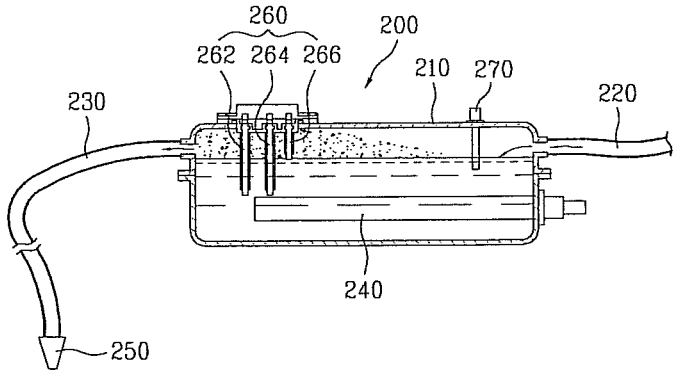
FIG. 3 RELATED ART
FIG. 3 is a sectional view illustrating a steam generator shown in FIG. 1.

On the other hand, the steam generator 200 is provided in a predetermined portion of the cabinet 10 to generate steam and the generated steam is supplied to the drum 20. In reference to FIG. 3, the steam generator 200 will be explained in detail.

The steam generator 200 is configured of a tank 210, a heater 240, a water level sensor 260 and a temperature sensor 270. Water is held in the tank 210 and the heater 240 is mounted in the tank 210. The water level sensor 260 senses water levels in the steam generator 200 and the temperature sensor 270 senses temperatures in the steam generator 200. The water level sensor 260 is configured of a common electrode 262, a low water level electrode 264 and a high water level electrode 266. A high water level is sensed based on whether an electric current is applied between the common electrode 262 and the high water level electrode 266, and a low water level is sensed based on whether an electrode current is applied between the common electrode 262 and the low water level electrode 264.

A water supply hose 220 is connected to a predetermined portion of the steam generator 200 and a steam hose 230 is connected to the other opposite predetermined portion of the steam generator 200. Here, it is preferable that a nozzle 250 having a predetermined shape is provided at a front end of the steam hose 230. An end of the water supply hose 220 is typically connected to an external water supply source such as a water tap. The nozzle 250, that is, a steam outlet is positioned at a predetermined portion in the drum 20 to spray steam in the drum 20.

In the meantime, this laundry dryer presents a kind of the steam generator 200 in that the heater 240 heats the water in the tank 210 to generate steam (called as tank heating type steam generator on convenience sake) and this laundry dryer is not limited thereto. That is, any devices capable of generating steam may be applicable to this laundry dryer. For example, a kind of a steam generator in that a heater is directly installed around a water supply hose to heat the water in the water supply hose, without storing water in a predetermined space, (called as a pipe heating type steam generator) may be applicable to this laundry dryer.

In reference to FIG. 4, another laundry dryer according to the present invention will be explained.

In the above-mentioned laundry dryer having a steam generator, to supply proper moisture to the laundry and heat the laundry, high temperature steam is generated by the steam generator having an auxiliary heat source and the steam is supplied to the drum. However, in this embodiment, steam is generated by using a hot air heater 90 commonly provided in a dryer, not using an auxiliary heat source like the above-mentioned laundry dryer.

In reference to FIG. 4, this embodiment of the present invention will be explained in detail.

The hot air heater 90 includes a heat generating part 94 for generating heat and a housing 92 for holding the heat generating part 94. The heat generating part 94 may be a gas burner in case of a gas-type dryer or a coil burner in case of an electric-type dryer. The housing 92 holds the heat generating part 94 as an auxiliary housing 92 or a part of the duct.

This embodiment presents that water is heated by using the heat generated at the hot air heater 90 to generate steam.

That is, without any auxiliary heat sources, water is heated by adapting the heat generating part 94 of the hot air heater 90 as a heat source to generate steam. For that, a water heating part 400 is provided at any positions capable of using the heat of the hot air heater 90 to heat water for steam and it is preferable that the water heating part 400 is installed at the housing 92 or adjacent to the housing 92. It is also preferable that the water heating part 400 is formed in a pipe shape and the water heating part 400 is made of metal with good heat transmission such as Cu, Al and Sus.

Figure 4:
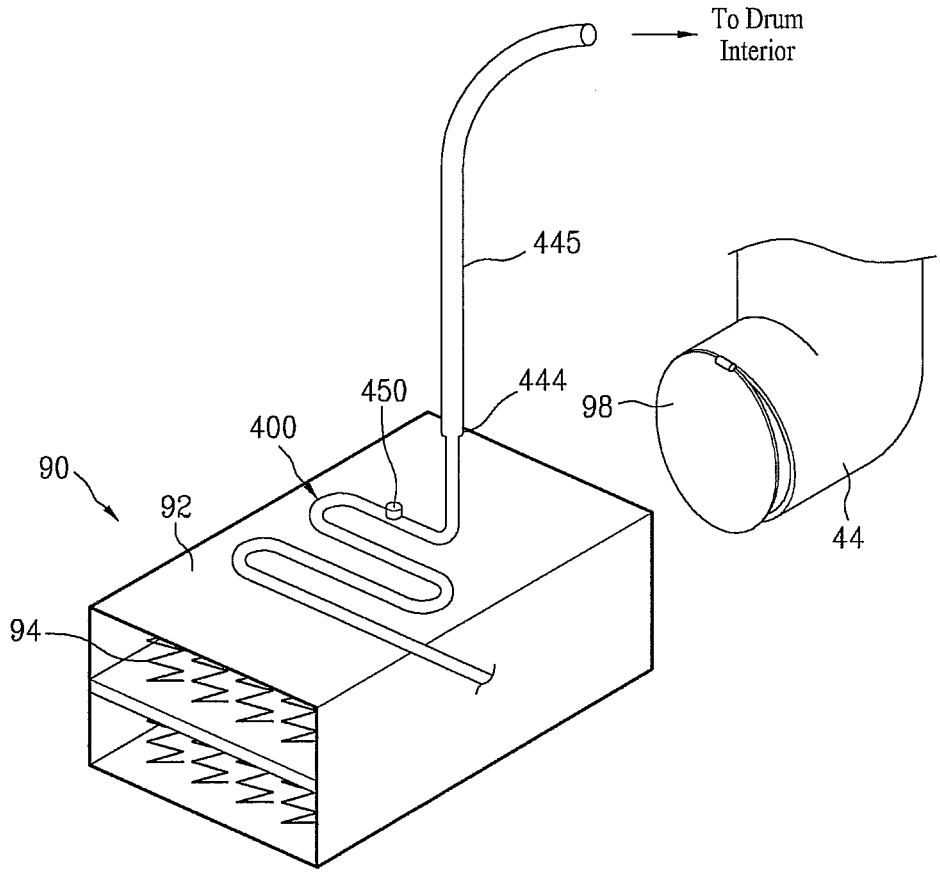
FIG. 4 is a perspective view schematically illustrating another laundry dryer according to the present invention.

FIG. 4 illustrates that the water heating part 400 is secured to an outer surface of the housing 92. While the water heating part 400 may be installed at any of an upper/lower inner or outer surface of the housing 92, it is preferable in view of installation convenience that the water heating part 400 is installed at an upper outer surface of the housing 92. A method of installing the water heating part 400 on the outer surface of the housing 92 may be varied and it is simple to mold the pipe shaped water heating part 400. In addition, a temperature sensor 450 is provided in a predetermined portion of the water heating part 400 to control the water heating part 400. Here, the temperature sensor 450 may be a thermistor.

In the meantime, since the hot air heater 90 is employed as a heat source for generating steam, a damper 98 is further provided at a hot air supply duct to selectively stop the hot air from being supplied to the drum. As a result, it is possible to supply the steam, not the hot air, to the drum even during the operation of the hot air heater 90. Also, a shown in FIG. 4, a steam hose 445 may be connected to an outlet 444 of the water heating part 400 and an outlet of the steam hose is installed at a predetermined portion including an upper portion of the drum to supply steam to the drum, or steam may be supplied to the drum by using the hot air supply duct without an auxiliary steam hose.

Figure 5:
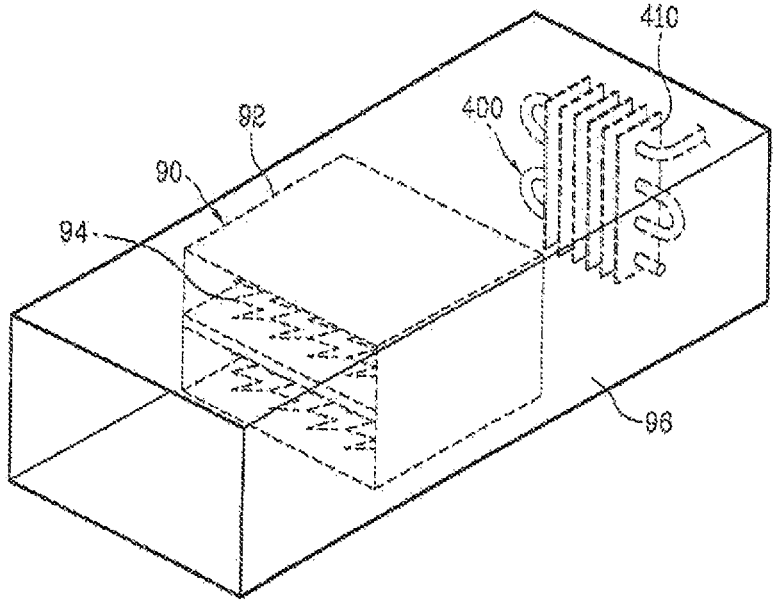
FIG. 5 is a perspective view schematically illustrating a further embodiment of a dryer according to the present invention.

In reference to FIG. 5, another embodiment of the present invention will be explained.

This embodiment also presents that steam is generated by using the heat of the hot air heater 90 except that the water heating part 400 is adjacent to the hot air heater 90 or the housing 92. Specifically, in this embodiment, the water heating part 400 is provided in rear or front of the housing 92 along a path of the hot air: that is, an upper stream or a lower stream in a view of air inflow. Considering air inflow, it is preferable that the water heating part 400 is installed in front of the housing 92.

On the other hand, a plurality of fins 410 may be provided to enhance heat transmission efficiency of the metal water heating part 400, because the water heating part 400 is directly connected to the housing 92. That is, it is preferable that a kind of fin-tube type heat-exchanger is adapted. Of course, even if the water heating part 400 is installed at the outer surface of the housing 92 according to above embodiment, fins may be used.

In addition, a duct 96 may be further provided to hold the hot air heater 90 and the water heating part 400 to prevent heat loss. It is preferable that a temperature sensor (not shown) is installed in a predetermined portion of the water heating part 400.

It is also preferable that a damper (98, see FIG. 4) is further provided in the hot air supply duct 44 to selectively stop the hot air from being supplied to the drum, because the hot air heater 90 is used as a heat source for generating steam in this embodiment. With this configuration, it is possible to supply only steam, not hot air, to the drum even during the operation of the heat air heater 90.

On the other hand, a steam hose (not shown) may be connected to an outlet of the water heating part 400 and an outlet of the steam hose may be installed at a predetermined portion including an upper portion of the drum to supply the steam to the drum, or steam is supplied to the drum by using the hot air supply duct 44 without an auxiliary steam hose.

Figure 6:
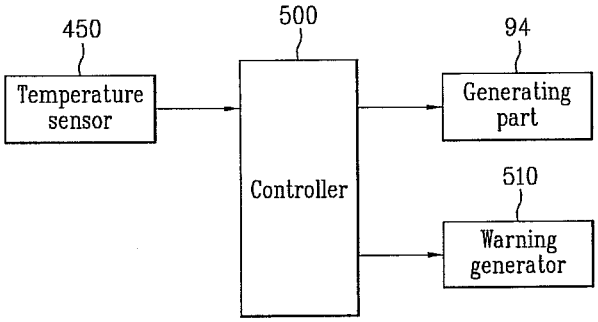
FIG. 6 is a block view schematically illustrating a control configuration of the dryer according to the present invention.

In reference to FIG. 6, a control configuration and control method according to the above embodiment will be explained.

An input terminal of a controller 500 is connected to the temperature sensor 450 and output terminals of the controller 500 are connected to the heat generating part 94 and a warning generator 510, respectively. The warning generator 510 gives a warning to a user and it may be configured of a lamp, an alarm and variations of them.

In case of an electric heater of 200 W, the temperature of the heat generating part 94 is at approximately 145~160° C. If the temperature of the water heating part 400 is near a boiling point of water, for example, at approximately 95~110° C., water is heated and steam is generated. However, if the temperature of the water heating part 400 is beyond a predetermined range of temperatures, for example, at approximately 95~110° C., the condition can be determined abnormal and thus the abnormal condition may be notified to the user.

For example, if the temperature of the water heating part 400 is higher than 95~110° C., it is determined that there is a failure in the water supply line including the water supply source. Thus, if there is a failure in the water supply line, it is preferable that the failure is notified to the user and the operation of the heat generating part 94 such as the heater is stopped for safety, such that the user may take appropriate actions including checking whether there is a failure in the water supply line.

In addition, if the temperature of the water heating part 400 is lower than 95~110° C., there might be a failure of the heat generating part 94 and it is preferable that the failure is notified to the user. At this time, as there is a possibility that a rated heat amount is not generated at the heat generating part 94, the operation of the heat generating part 94 does not have to be stopped or may be stopped for complete safety. A control method using the temperature of the heat generating part 94 sensed at the temperature sensor 450 may be limited to what is explained above and may be embodied in various ways.

In reference to FIGS. 4 to 6, an operation of the above embodiments according to the present invention will be explained.

Once the laundry dryer is operated, water is supplied to the water heating part 400 and the hot air heater 90 is operated based on an operational condition selected by a user, for example, at a condition in that steam is needed. The heat generated at the hot air heater 90 is conducted to the water heating part 400 through the housing 92. Hence, the water heating part 400 is heated by the heat conduction to change water into steam and the steam is discharged from an outlet of the water heating part 400. As the hot air heater 90 commonly generates hot air, it is possible to generate steam by using the hot air heater 90. The steam generated at the water heating part 400 is supplied to the drum and it is sprayed to the laundry uniformly, which results in removing wrinkles of the laundry.

According to experiments performed by the inventor, although there is difference according to kinds of fabrics and humidity of the laundry, there is an effect of removing and preventing wrinkles in the present invention. For example, wrinkles of the laundry washed in a washer may be removed and the present invention is applicable to various kinds of laundry. For example, clothes worn for about a day, that is, dried laundry with fewer wrinkles may be used in the present invention. In other words, the laundry dryer according to the present invention may be used as a kind of wrinkle removal apparatus.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention has an industrial applicability.

First, the laundry dryer according to the present invention has an effect of efficiently preventing wrinkles of the dried laundry in advance. In addition, the laundry may be sterilized and bad smell of the laundry may be removed.

Furthermore, the laundry dryer according to the present invention has another advantageous effect of efficiently removing wrinkles of the dried laundry without auxiliary ironing.

A still further, the laundry dryer according to the present invention has a further advantageous effect of a simple structure, because an external water tap is not connected to the steam generator provided in the laundry dryer.

The invention claimed is:

1. A laundry dryer, comprising:

a drum in which laundry is held;

a hot air heater that heats air to supply hot air to the drum, wherein the hot air heater includes a heat generator that generates heat and a housing in which the heat generator is located;

a hot air supply duct to supply the air heated by the hot air heater to an interior of the drum;

a water heater that heats water from an eternal water supply source using heat generated by the hot air heater to generate steam, wherein the water heater is provided at a front location or a rear location of the housing within the hot air supply duct and includes an enclosed pipe, through which the water flows, the enclosed pipe having a plurality of straight portions and a plurality of curved portions, and at least one fin coupled to the enclosed pipe, wherein the plurality of straight portions and the plurality of curved portions and the at least one fin function to transfer heat from the air heated by the hot air heater to the water flowing in the enclosed pipe to generate the steam, wherein the enclosed pipe is directly exposed to the hot air supplied to the interior of the drum so that before the hot air is supplied to the interior of the drum, the water in the enclosed pipe is heated by the hot air to change the water in the enclosed pipe into the steam; and a steam hose coupled to an outlet of the enclosed pipe, that supplies the steam generated in the enclosed pipe to the interior of the drum, wherein an outlet of the steam hose is installed at an upper portion, of the drum.

2. The laundry dryer as claimed in claim 1, wherein the water heater is located adjacent to the housing, and wherein heat from the heat generator passes through a surface of the housing to provide heat for the water heater.

3. The laundry dryer as claimed in claim 1, further including a temperature sensor provided at a predetermined portion of the water heater.

4. The laundry dryer as claimed in claim 3, further including a control circuit to stop the hot air heater from generating heat when a temperature of the water heater or water from the water heater is determined to exceed a predetermined temperature range.

5. The laundry dryer as claimed in claim 3, further including a warning generator that provides a warning to it user when a temperature of the water heater or water from the water heater is determined to exceed a predetermined temperature range.

6. The laundry dryer as claimed in claim 1, further including a damper that selectively prevents the hot air generated at the hot air heater from being supplied to the drum.

7. The laundry dryer as claimed in claim 6, wherein the damper is provided at the hot air supply duct that supplies the hot air from the hot air heater to the drum.

* * * * *